United States Patent [19]

Surti

[11] Patent Number: 4,629,346

[45] Date of Patent: Dec. 16, 1986

[54] PRINTER RIBBON CASSETTE

[76] Inventor: Tyrone N. Surti, Rte. 8, Box 8115, Manchester, Tenn. 37355

[21] Appl. No.: 725,931

[22] Filed: Apr. 22, 1985

[51] Int. Cl.[4] ..... B41J 35/28

[52] U.S. Cl. ..... 400/208; 400/223

[58] Field of Search ..... 400/207, 208, 208.1, 400/223, 235; 242/192, 200

[56] References Cited

U.S. PATENT DOCUMENTS 3,942,743 3/1976 Jinsenji ..... 242/192
4,264,223 4/1981 Bemis et al. ..... 400/223 X
4,496,255 1/1985 Meintrup et al. ..... 400/208
4,528,572 7/1985 Sasaki et al. ..... 400/120 X

FOREIGN PATENT DOCUMENTS 56-33974 4/1981 Japan ..... 400/208.1

*Primary Examiner*—Charles Pearson
*Attorney, Agent, or Firm*—C. A. Phillips

[57] ABSTRACT

A printer ribbon cassette of the type employing two ribbon spools. In this one, the ribbon is driven by a belt engaging the spools and, in turn, the belt is engaged by both of two alternately driven drive rollers and wherein each drive roller, when it is driven, effects removal or unwinding of ribbon from the spool with which it is directly associated.

1 Claim, 3 Drawing Figures

PRINTER RIBBON CASSETTE

TECHNICAL FIELD

This invention relates generally to printing ribbon holders and particularly to a spool-type ribbon cassette.

BACKGROUND OF THE INVENTION

It is common practice today to employ a ribbon cassette wherein there are two ribbon storage spools and a ribbon engageable by a print head of a printer is supplied from these spools. In at least one configuration of such a cassette, there are two capstans, alternately driven by the printer, and each being associated with and driving one of the two spools and in a direction wherein the ribbon is advanced by a capstan toward its associated spool. Only one of the drive rollers is rotated or rotates at one time, there being a drive connection on each side to a capstan, whereby, alternately, one or the other of the capstans is driven. A capstan drives, via a belt, the associated spool. When a ribbon has been driven its maximum length in one direction, the cassette is turned over and the other capstan is driven from the opposite side of the cassette. In order to effect this change, however, it is necessary for the user to uncouple the belt on one side and couple it between a capstan pulley and spool pulley on the opposite side. This is an inconvenient step and, of course, necessitates the provision of external belt drive pulleys and an external belt.

It is an object of this invention to eliminate the belt change step and to eliminate the structure which is required in such an exterior belt-type construction.

SUMMARY OF THE INVENTION

In accordance with the present invention, one drive roller driven by a printer drives an internally located belt, and this belt drives in unison a ribbon, an idler roller, and a second drive roller. The idler roller is positioned to hold the belt against the ribbon where it is wound on ribbon spools. As an added feature of this invention, the particular drive roller being driven by the printer rotates in a direction wherein the ribbon is driven off of its associated spool rather than onto it, sometimes an advantage in that in this manner there is tension between a drive roller and an associated spool.

DETAILED DESCRIPTION OF THE DRAWINGS

Figure 3:
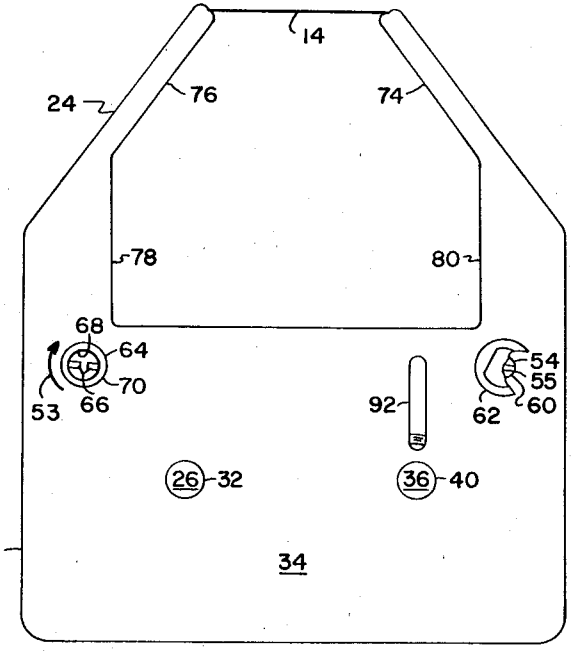
FIG. 3 is a bottom plan view of the cassette shown in FIG. 1.
Figure 2:
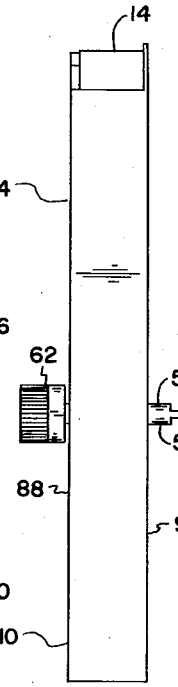
FIG. 2 is a side view of the cassette of FIG. 1.
Figure 1:
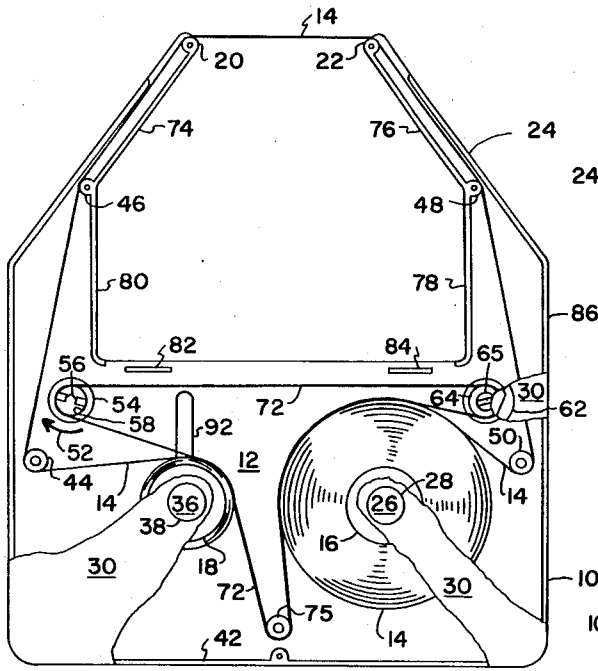
FIG. 1 is a top plan view, partially broken away, of an embodiment of a ribbon cassette constructed in accordance with the present invention.

Referring to the drawings, a ribbon case 10 houses in cavity 12 transport and storage means for a printing ribbon 14. Ribbon 14 is stored on and winds between spools 16 and 18 and is guided in a path which ultimately places it between ribbon guides 20 and 22. A print head from a host printer effects impacted through a generally central region of ribbon 14 between guides 20 and 22. Ribbon spools 16 and 18 are conventionally supported by openings in opposite covers of case 10. Thus, one side of axle 26 of spool 16 is supported by opening 28 in side cover 30, and the opposite side of axle 26 is supported in an opening 32 in side cover 34 of case

10. Similarly, axle 36 of spool 18 is supported in an opening 38 in cover 30 on one side and by an opening 40 in side 34 of case 10. Case 10 is formed of a basic enclosure 42 which includes side 34 and is finally enclosed by cover 30, being attached together by means not shown. Ribbon 14 follows the path shown wherein it passes from spool 18, by guide roller 44, guide 46, then between guides 20 and 22, then by guide 48, around guide roller 50, and finally to spool 16. The ribbon is alternately driven from spool 16 to spool 18 and then from spool 18 to spool 16. Direction would be changed when the ribbon on a spool is exhausted.

Ribbon drive in one direction, in the direction of arrow 52, is effected by engagement of drive roller 54 with a mating drive member of a host printer via the drive pins 56 within an opening 58 of drive roller 54. Drive roller 54 is supported in an opening in cover 30 (not shown) and on the opposite side by an opening 60 in cover 34. A removable knob 62 (FIG. 3) is loosely pressed onto shaft 55 of drive roller 54. Knob 62 provides a convenient method of checking that a belt drive is free and the ribbon in a proper operating state. Aside from this role, it is unnecessary.

Drive roller 64 is identical to drive roller 54 but is positioned reverse to that of guide roller 54, thus its drive pins 66 are accessible in an opening 68 of drive roller 64 on the opposite side of the cassette 24. Drive roller 64 is supported in an opening 70 in side 34 and an opening (not shown) in cover 30. Thus, drive roller 64 is drivable from the host printer from the opposite side of case 10 but otherwise in the same manner as drive roller 54.

The interfacing drive of the host printer turns in a single direction as indicated by arrow 52. Thus, by reversing cassette 10 and turning it over, wherein roller 54 rather than roller 64 is engaged, the drive mechanism internal to cassette 10 operates in a reverse direction to reverse the direction of movement of ribbon 14. In the reverse position, knob 62 would be removed from shaft 55 on roller 54 and pressed onto corresponding shaft 65 of roller 64 on the upper cover 30 of cassette 10 and would enable hand drive of the cassette from this orientation.

Ribbon 14 is driven by a belt 72 which is in turn driven by the one of drive rollers 54 and 64 being driven by the printer. Belt 72 passes over and is engaged by both of drive rollers 54 and 64, and it effects drive of ribbon 14 by engagement with the ribbon in regions where the ribbon is wound on spools 16 and 18, tension to the belt being enabled by idler roller 75. Idler roller 75 may be regarded as being generally positioned along a line perpendicular to a line between the axis of spools 16 and 18, and, as shown, below spools 16 and 18. Its position is such that belt 72 is significantly engaged with ribbon 14 on spools 16 and 18. Belt 72 is tensioned sufficient to prevent slippage between belt 72 and ribbon 14 and to thus insure positive engagement.

As will be noted by arrow 52, when drive roller 54 is driven, which would be in the direction of arrow 52, its associated spool 18 would be rotated, through its engagement with the ribbon, in a direction wherein ribbon 14 is operated off of or unwound from its associated spool 18. Similarly, in the event that drive roller 64 is operated, its operation would be in the direction of arrow 53, and its associated spool, spool 16, would be rotated in a direction wherein ribbon 14 is unwound off of spool 16.

The general configuration of cassette 10 is similar to other cassettes wherein there is the generally U-shaped opening formed by outreaching supports 74 and 76 which mount guides 20 and 22. Ridge members 78, 80, 82, 84, and 86 form separating supports to provide stability to the cassette. When in place, cover 30 is against them.

To use cassette 10, one side of it, side 88 or 90, would be positioned generally horizontally on a printer with the mating drive roller on that side in engagement with the drive mechanism of the printer. As the printer is operated, the driven mechanism rotates that drive roller which causes belt 72 to proceed in one direction. When there is an indication that the ribbon is driven in a corresponding direction to its extremities wherein there is no ribbon on the drive roller associated with one spool, then the cassette is removed, turned over, and reinstalled with the opposite drive roller engaged with the printer. An indication of the ribbon on a spool is enabled by a slot 92 in each side of the cassette, one of these slots being shown in cover 34. When the cassette is reversed, the direction of drive of the ribbon is reversed, and thus the feed will be restarted and continue until the ribbon is again completely wound from one spool to another. By this arrangement, the print head of the printer is, of course, constantly striking a different area of the ribbon, enabling full utilization of the ribbon.

From the foregoing, it is to be appreciated that there has been provided a significantly simplified cassette in both structure and operation. Structurally, the rather standard external belt pulling arrangement is eliminated, and there is no necessity for taking the belt off one side and placing it on the other.

What is claimed is:

1. A ribbon cassette for a printer including a drive member adapted to rotate in a single direction and comprising:

a case having an internal storage cavity generally defined by broad opposite face sides, first, top and second, bottom, opposite sides, and third and fourth opposite sides and first and second spaced guides supported by said case and being located along a line generally parallel with, said first, top, side of said cavity;

firat and second spools positioned within said cavity and a ribbon extending between said guides and being wound on said spools, said ribbon defining a ribbon path extending from one of said spools to the other of said spools, said ribbon path extending across the top region of said first spool in an outward direction toward said third side, and from the top region of said second spool in an outward direction toward said fourth side, wherein said top region of said spools is the region facing said first, top, side of said cavity;

first and second spaced drive rollers within said cavity, said first drive roller having a drive member adapted to be driven from said printer through one said broad side of said case, and said second drive roller having a drive member adapted to be driven from said printer through an opposite said broad side of said case;

an idler roller positioned inward of said spools and generally along a line which is perpendicular to a line between the axes of said spools and on an opposite side of the line between the axes of said spools than is the line between said spaced guides;

a first guide roller positioned in the path of said ribbon between said first spool and said first guide and a second guide roller positioned in the path of said ribbon between said second spool and said second guide, said first guide roller being positioned to define said ribbon path so that the ribbon passes outwardly of said first drive roller and then inwardly toward said first spool as said ribbon is being wound on said first spool, said second guide roller being positioned to define said ribbon path so that the ribbon passes outwardly of said second drive roller and then inwardly toward said second spool as said ribbon is being wound on said second spool;

said first spool being positioned between said first drive roller and said idler roller, and said second spool being positioned between said second drive roller and said idler roller;

a belt extending around said drive rollers and said idler roller and engaging said ribbon wound on said spools, whereby said belt, and thereby said ribbon, is alternately drivable by one of said drive rollers;

wherein drive in said single direction of said printer of said first drive roller, and the resulting drive of said first spool by said belt, drives said first spool in an unwinding direction, and the drive of said second drive roller by said printer in said single direction drives said belt and said second spool in an unwinding direction; and wherein said belt and said ribbon separate at points on the periphery of said spools so as to form discrete angles of separation, the angle formed at said first spool generally opening toward said third side and the angle formed at said second spool generally opening toward said fourth side.

* * * * *